US008920209B2

(12) United States Patent
Brooks et al.

(10) Patent No.: US 8,920,209 B2
(45) Date of Patent: Dec. 30, 2014

(54) SPINNING TOY APPARATUS

(75) Inventors: Meredith Brooks, Attleboro, MA (US); Dean Carley, Barrington, RI (US); Sean Carmine Isabella, Brighton, MA (US)

(73) Assignee: Hasbro, Inc., Pawtucket, RI (US)

( * ) Notice: Subject to any disclaimer, the term of this patent is extended or adjusted under 35 U.S.C. 154(b) by 180 days.

(21) Appl. No.: 13/451,379

(22) Filed: Apr. 19, 2012

(65) Prior Publication Data

US 2013/0102223 A1 Apr. 25, 2013

Related U.S. Application Data

(60) Provisional application No. 61/478,521, filed on Apr. 24, 2011.

(51) Int. Cl.

| | |
|---|---|
| ***A63H 33/00*** | (2006.01) |
| ***A63H 1/04*** | (2006.01) |
| ***A63H 1/00*** | (2006.01) |
| ***A63H 1/20*** | (2006.01) |
| ***A63H 1/02*** | (2006.01) |
| ***A63H 1/24*** | (2006.01) |
| ***A63H 29/20*** | (2006.01) |
| ***A63H 9/00*** | (2006.01) |
| *A63F 9/00* | (2006.01) |

(52) U.S. Cl.

CPC .. *A63H 1/00* (2013.01); *A63H 1/04* (2013.01); *A63H 1/20* (2013.01); *A63H 1/02* (2013.01); *A63H 1/24* (2013.01); *A63F 2009/0021* (2013.01); *A63H 29/20* (2013.01); *A63H 9/00* (2013.01)

USPC ..... 446/236; 446/234

(58) Field of Classification Search

USPC ..... 74/89.17, 422; 446/233–235, 268, 236, 446/242

See application file for complete search history.

(56) References Cited

U.S. PATENT DOCUMENTS

| | | | | |
|---|---|---|---|---|
| 755,446 | A | 3/1904 | Butcher | |
| 901,762 | A * | 10/1908 | Wetzel | 446/297 |
| 1,098,895 | A | 6/1914 | Edgar | |
| 1,349,202 | A * | 8/1920 | Holbrook et al. | 446/273 |
| 1,594,649 | A | 8/1926 | Trautmann | |
| 1,763,903 | A * | 6/1930 | Perkins | 446/273 |
| 2,148,374 | A | 2/1939 | Hogan | |

(Continued)

OTHER PUBLICATIONS

PCT/US2012/034286—International Search Report. dated Jun. 29, 2012.

(Continued)

*Primary Examiner* — Gene Kim
*Assistant Examiner* — Urszula M Cegielnik
(74) *Attorney, Agent, or Firm* — Perry Hoffman

(57) ABSTRACT

A toy apparatus having a lower base, an upper base and a doll cover for the upper base where the lower base and the upper base attach and detach with an easy twisting motion. The lower base encloses a flywheel on a shaft, and a passageway for a rack and includes a cover with an outside screw thread. The upper base is either empty or encloses three switches, a sound generator, a light source, a controller printed circuit board, and a battery chamber and includes a cover with an inside screw thread that mates with the screw thread of the lower base. The toy apparatus has two primary play modes, a first mode where the lower base, the upper base and the cover are connected and a user uses the rack to spin the flywheel.

18 Claims, 8 Drawing Sheets

(56) References Cited

U.S. PATENT DOCUMENTS

| | | | | | |
|---|---|---|---|---|---|
| 2,195,083 | A | | 3/1940 | Einfalt | |
| 2,364,117 | A | | 12/1944 | Wigal | |
| 2,611,995 | A | | 9/1952 | Krapp | |
| 2,736,132 | A | | 2/1956 | Murray | |
| 3,229,416 | A | | 1/1966 | Bross | |
| 3,229,543 | A | | 1/1966 | Bross | |
| 3,531,892 | A | | 10/1970 | Pearce | |
| 3,686,790 | A | | 8/1972 | Winston | |
| 3,732,645 | A | | 5/1973 | Winston | |
| 3,757,467 | A | | 9/1973 | Von Winckelmann | |
| 3,921,331 | A | * | 11/1975 | Schatz | 446/297 |
| 3,932,957 | A | | 1/1976 | Morrison et al. | |
| 3,945,146 | A | | 3/1976 | Brown | |
| 4,185,739 | A | | 1/1980 | Wilford | |
| 4,193,223 | A | | 3/1980 | D'Andrade et al. | |
| 4,261,466 | A | | 4/1981 | Wilford | |
| 4,277,912 | A | | 7/1981 | Hsien | |
| 4,588,336 | A | | 5/1986 | Navarro | |
| 4,695,262 | A | | 9/1987 | Crosby et al. | |
| 4,713,039 | A | | 12/1987 | Wong | |
| 4,722,238 | A | | 2/1988 | Navarro | |
| 4,772,241 | A | * | 9/1988 | Bro et al. | 446/202 |
| 4,867,727 | A | | 9/1989 | Lanius | |
| 4,940,441 | A | * | 7/1990 | Novinsky | 446/46 |
| 4,959,035 | A | | 9/1990 | Murasaki | |
| 5,411,138 | A | | 5/1995 | Klawiter | |
| 5,572,908 | A | | 11/1996 | Bruder | |
| 5,743,781 | A | | 4/1998 | Lee | |
| 5,791,966 | A | | 8/1998 | Capps et al. | |
| 5,823,845 | A | | 10/1998 | O'Berrigan | |
| 5,896,991 | A | | 4/1999 | Hippely et al. | |
| 5,957,745 | A | | 9/1999 | Johnson et al. | |
| 6,042,449 | A | * | 3/2000 | Ishimoto | 446/234 |
| 6,221,409 | B1 | | 4/2001 | Bueno Ceresuela | |
| 6,227,929 | B1 | * | 5/2001 | Nelson et al. | 446/239 |
| 6,270,391 | B1 | | 8/2001 | Emilsson | |
| 6,406,349 | B1 | | 6/2002 | Chung | |
| 6,612,895 | B2 | * | 9/2003 | Sze | 446/233 |
| 6,672,790 | B2 | | 1/2004 | Davis | |
| 6,676,476 | B1 | | 1/2004 | Lund et al. | |
| 6,743,072 | B2 | * | 6/2004 | Nelson et al. | 446/490 |
| 7,033,304 | B2 | | 4/2006 | Chuang et al. | |
| 7,037,169 | B2 | | 5/2006 | Benedek et al. | |
| 7,072,621 | B1 | | 7/2006 | Engstrom et al. | |
| 7,179,149 | B2 | * | 2/2007 | Chernick et al. | 446/242 |
| 7,258,591 | B2 | * | 8/2007 | Xu et al. | 446/273 |
| 7,296,679 | B2 | | 11/2007 | Lam | |
| 7,740,518 | B2 | | 6/2010 | Elliott | |
| 2004/0040349 | A1 | | 3/2004 | Guttadauro et al. | |
| 2006/0292962 | A1 | | 12/2006 | Takeyasu et al. | |

OTHER PUBLICATIONS

PCT/US2012/034286—Written Opinion of the International Searching Authority. dated Jun. 29, 2012.

PCT/US2012/034286—Notification of Transmittal of the International Search Report and the Written Opinion of the International Searching Authority or the Declaration. Jun. 29, 2012.

* cited by examiner

SPINNING TOY APPARATUS

PRIORITY CROSS-REFERENCE TO RELATED APPLICATION

This application claims priority pursuant to 35 U.S.C. 119 (e) from U.S. Provisional Patent Application, No. 61/478,521 filed on Apr. 24, 2011.

FIELD OF THE INVENTION

The present invention relates generally to a toy apparatus, and, more particularly, to a separable toy apparatus that enables two modes of primary play, one mode where a flywheel in the toy apparatus spins rapidly, and a second mode where an upper portion of the toy apparatus is covered and may be hand held. In a variation the toy apparatus includes sounds and lights.

BACKGROUND OF THE INVENTION

Toys are often designed to have play value by using a rapidly spinning flywheel to achieve a gyroscopic effect. Examples of earlier issued patents and published application are identified below.

U.S. Pat. No. 1,098,895 for a "Toy" issued in 1914 to Edgar purports to disclose a small figure having a flywheel located in the middle of the figure. The figure has an extend toe, a support point on its head and a surface on a hand, any of which are able to support and balance the figure and have it revolve when the flywheel is rotated at high speed. U.S. Pat. No. 1,594,649 for a "Skipping Toy" issued in 1926 to Trautmann purports to disclose a doll having an internal gyroscope and extended arms holding a skipping rope. Spinning the gyroscope allows the arms of the doll to move and the doll to travel along a surface or wire. Another U.S. Pat. No. 2,148,374 for a "Toy" issued in 1939 to Hogan, also purports to disclose a doll with an internal gyroscope able to perform head-up and head-down simulating ice-skating or tightrope walking.

A year later U.S. Pat. No. 2,195,083 for a "Toy Dancing Figure" issued to Einfalt, and purports to disclose a toy ballet dancer with an internally located gyroscope. The gyroscope is activated by a toothed rack, which engages a pinion attached to the shaft of the gyroscope. Four years later U.S. Pat. No. 2,364,117 for a "Gyroscopic Toy" issued to Wigal, and purports to also disclose a toy figure with an internally located gyroscope. The gyroscope is driven and controlled by motor, such as spring type mechanical motor or an electric motor that acts as a speed regulator. U.S. Pat. No. 2,736,132 for a "Gyroscopic Figure Toy" issued in 1956 to Murray purports to disclose yet another toy figure with an internally located gyroscope. The toy figure includes points and grooves at the head, the legs and the arms so that the figure may be balanced on a flat surface or a string at any of the points and grooves.

In 1987, U.S. Pat. No. 4,713,039 for a "Gyroscopic Toy" issued to Wong, and purports to disclose a toy top with an internally located, battery driven gyroscope. The top contains noise generators and flashing lights controlled by a centrifugally activated switch. U.S. Pat. No. 5,823,845 for a "Mobile, Gyroscopically Stabilized Toy With Controlled Multi-Action Movements" issued in 1998 to O'Berrigan, and purports to disclose a toy with an internally located gyroscopic that may be battery operated and with mechanical linkages, also battery operated, that provide for motion of the toy and for body and appendages movement. U.S. Pat. No. 5,957,745 for a "Gyroscopic Figurine" issued in 1999 to Johnson purports to disclose a toy figurine with an internally located motor driven gyroscope that is slightly offset to cause the figurine to vibrate or wobble for enhancing a skating effect on a flat surface on which the figurine is placed.

In 2004 U.S. Pat. No. 6,676,476 for "Gyroscope Figures" issued to Lund and Starrick, and purports to disclose a toy figures each with an internally located gyroscope that is manually rotated by a flexible rack gear. The figures each have predetermined apertures that mate with posts on toy vehicles, such as a skateboard, a mountain board, a scooter, a bicycle and a car. Once a figure is attached to a vehicle and a user operating the flexible rack gear energizes the gyroscope in the figure, the vehicle is balanced and stabilized such that the vehicle may be moved in a specific direction. U.S. Patent Application Publication 2006/0292962 for a "Toy Figure With Gyroscopic Element" published in 2006, and listing Takeyasu, Strauss and Montalvo as inventors, purports to disclose a toy figure with an internally located gyroscope that is rotated by a pull string that rewinds automatically. U.S. Pat. No. 7,740,518 for a "Jousting Toy" issued in 2010 to Elliott purports to disclose rotatable toy devices each having a cylindrical body, and each with an internally located gyroscope that is rotated by a pull cord or a string. Each device may have two curvilinear arms and two loops. In a jousting game opposing players launch their spinning devices toward each other and points are gained when an arm of one device engages a loop of an opponent's device.

These Patents and Devices are of Interest, However, they do not Disclose or illustrate the toy apparatus disclosed herein below.

SUMMARY OF THE INVENTION

In accordance with the present invention, an advantageous method and apparatus are provided in the form of a toy that is formed in two housing parts, a lower part having a rotatable flywheel, the lower part being connectible to an upper part having a covering in the form of a fabric pet or doll, the upper part having switches, one or more batteries, a sound generator, a light source and a controller of the sounds and lights. The toy apparatus may be played with in either of two main modes, a first mode with the upper and lower parts connected and the flywheel energized so as to rotate the entire apparatus and actuate sounds and lights, and a second mode with the upper part detached from the lower part where the upper part may be hand held and a switch actuated manually to activate sounds and lights. The two-mode arrangement is achievable because the sound device, light source, batteries and controller are all housed in the upper part. Having the upper and lower parts easily detachable also allows other upper parts with different fabric coverings to be exchanged with the lower part so as to make the coverings collectible items. Having multiple coverings enable the appearance of the toy apparatus to be customized by interchanging different coverings and upper parts with a lower part during play. Connecting the upper and lower parts is accomplished by a simple twist motion, similar to that of connecting a lid to a jar.

The toy is robust, simply constructed, easy to use, quick to twist apart and ideally appropriate for young girls.

Briefly summarized, the invention relates to a toy apparatus including a housing enclosing a flywheel and a passageway for a rack to rotate the flywheel, a chamber for a battery, a plurality of switches, a sound generator and a controller, and a doll for covering a portion of the housing wherein the toy has two play modes, a first mode where the housing and doll spin rapidly to enable a switch to energize the sound generator, and a second mode where the housing and doll are handheld and another switch, manually operable, enables the sound generator to be energized. The invention may also be described differently as a toy apparatus including a lower base enclosing the flywheel and the passageway for a rack, an upper base detachably connectible to the lower base, the upper base enclosing the chamber for a battery, a first switch, a second switch, the sound generator and the controller for the sound generator, and the doll for covering the upper base wherein the first switch is manually operated and the second switch is actuated when the flywheel is spinning A more basic toy apparatus invention may include just the lower base enclosing the flywheel and the passageway for a rack to enable the flywheel to be energized, the upper base detachably connectible to the lower base, and a covering for the upper base. The rack is also novel and includes a handle, and an elongated flexible bar, the bar having a rectangular cross section with opposing surfaces wherein each of the opposing surfaces includes a series of evenly spaced recessed teeth for receiving teeth of a flywheel drive gear.

The invention also relates to a method for manufacturing the toy apparatus and includes the steps of forming the lower base having the rotatable flywheel, the passageway for receiving the rack to operate the flywheel and an outside screw thread, forming the upper base having the sound generator, the battery compartment, three switches, the controller and an inside screw thread for engaging the outside screw thread of the lower base, forming the doll to be placed over the upper base, and connecting the doll to the upper base.

BRIEF DESCRIPTION OF THE DRAWINGS

For the purpose of facilitating an understanding of the invention, the accompanying drawings and detailed description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
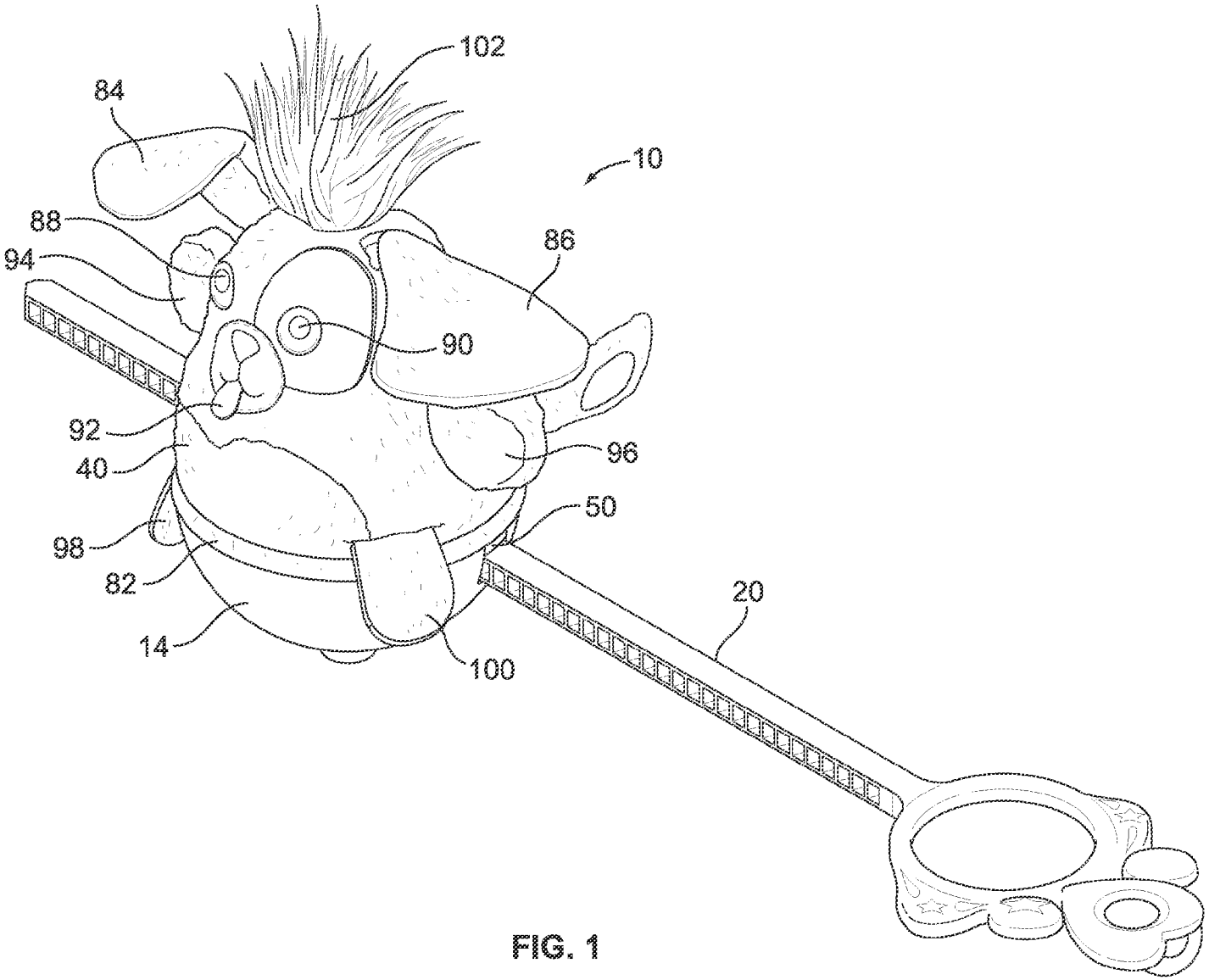
FIG. 1 is a front isometric view of a preferred embodiment of the present invention in the form of a doll covered housing toy apparatus having a flywheel capable of spinning.
Figure 2:
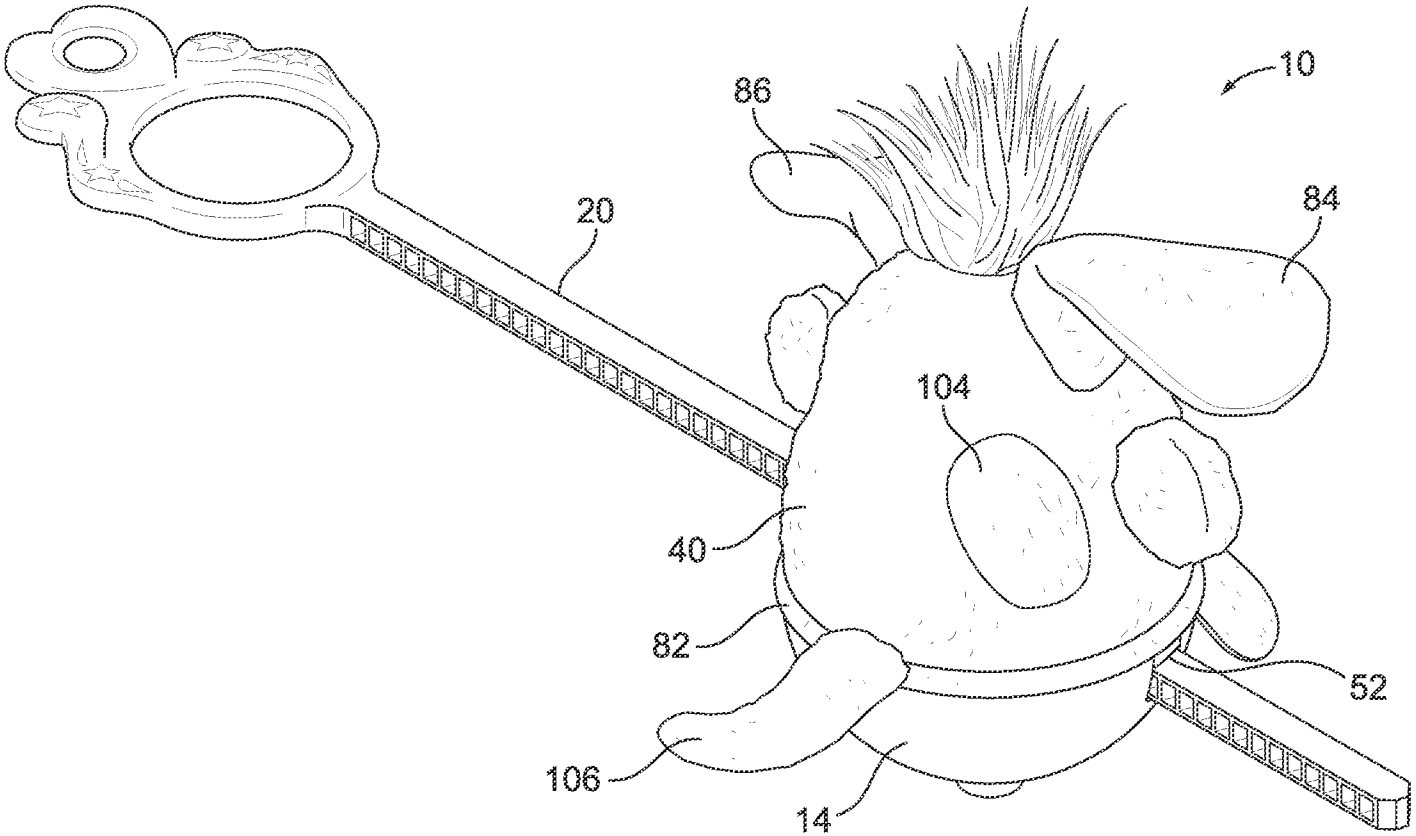
FIG. 2 is a rear isometric view of the toy apparatus shown in FIG. 1.
Figure 3:
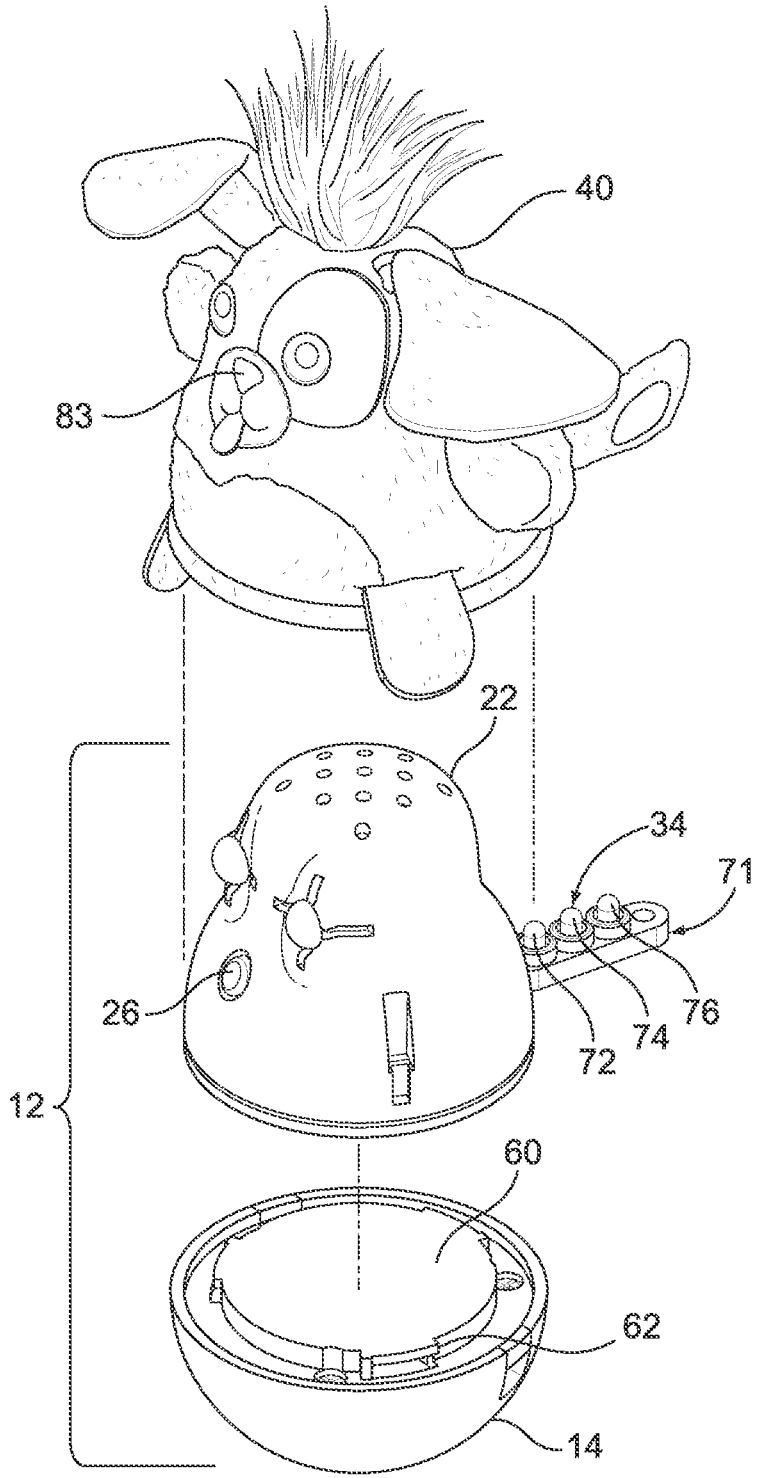
FIG. 3 is an isometric exploded view of the toy apparatus shown in FIGS. 1 and 2, but without a rack.
Figure 4:
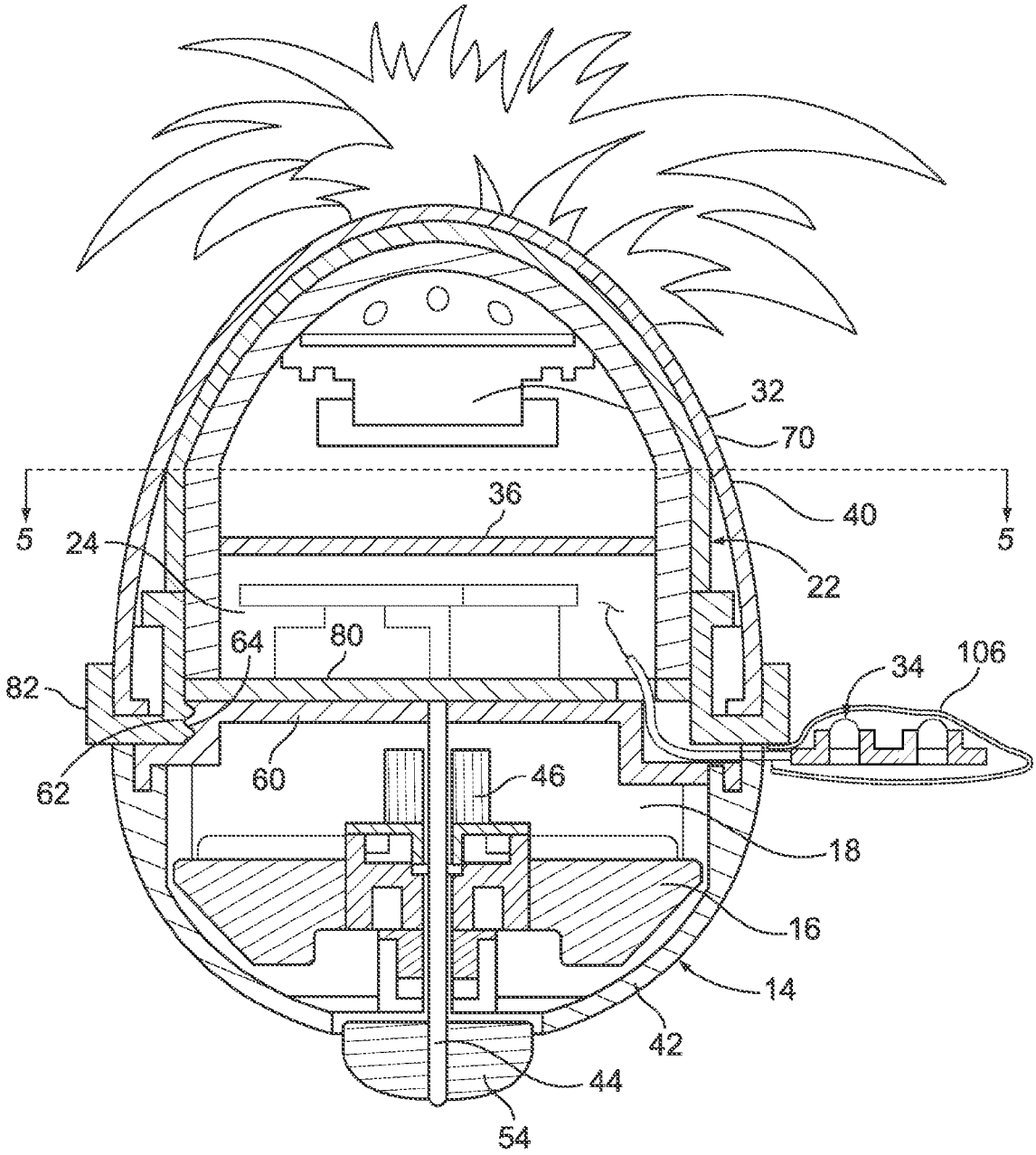
FIG. 4 is an enlarged cross-sectional elevation view of a toy apparatus similar to that shown in FIG. 3, but illustrating a housing of slightly different shape.
Figure 5:
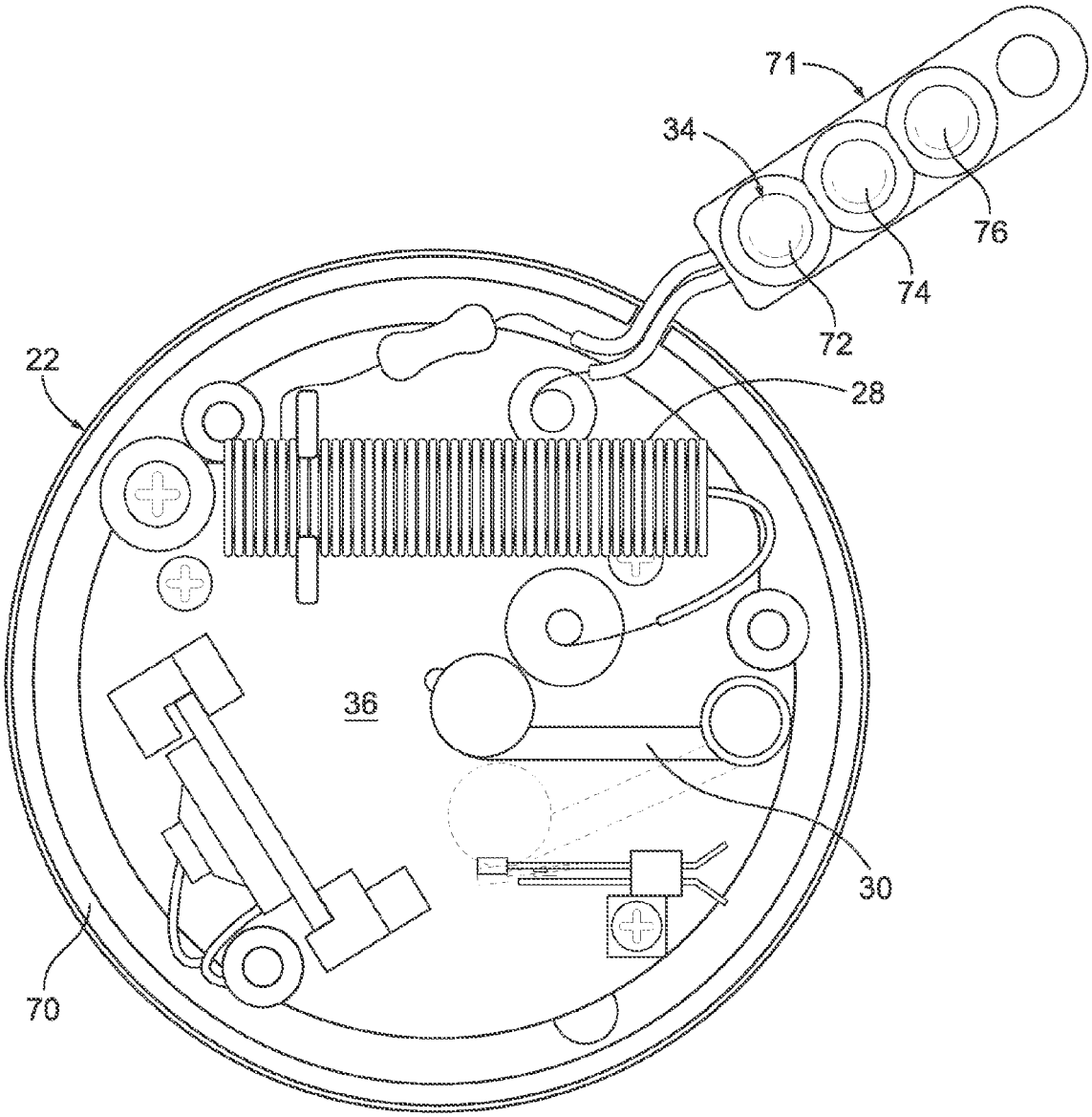
FIG. 5 is an enlarged plan cross-sectional view taken along line 5-5 of FIG. 4.

Referring now to the Figures, FIGS. 1-4, there is shown preferred embodiments of the invention in the form of a toy apparatus 10 having a two part housing 12 including a lower base 14 enclosing a flywheel 16 and a passageway 18 for a flexible rack 20 to rotate the flywheel rapidly, an upper base 22 connectible to the lower base 14 and enclosing a chamber 24 for one or more batteries, a manually operated first switch 26, centrifugally operated second and third switches 28, 30, FIG. 5, a sound generator 32, a light source 34 and a printed circuit board 36 for controlling the sound generator 32 and the light source 34. Another embodiment does not have the switches, the sound generator, the light source, the printed circuit board or batteries in the upper base.

Mounted to the upper base is a fabric doll 40 for covering the upper base 22. The toy apparatus 10 has two primary play modes, a first mode where the lower base 14, the upper base 22 and the doll cover 40 are connected together and are able to spin. If the switches, the sound generator, the light source, the printed circuit board and the batteries are installed, rotation of the flywheel 16 in the lower base 14 causes the sound generator 32 and the light source 34 to be activated by the second and third switches 28, 30. In a second mode where the upper base 22 and the doll cover 40 are disconnected from the lower base 14, the sound generator 32 and the light source 34 may be activated when a user presses the first switch 26. In the embodiment without the switches, the sound generator, the light source, the printed circuit board and the batteries the doll covered upper base may be a hand held collectible as explained below. A third mode of play is described below.

Alternatively, the toy apparatus may only include the sound generator and have no light source, or no sound generator and only a light source; the housing may be formed with two halves divided vertically and fastened together to form the toy apparatus with the doll covering an upper portion of the housing; and the toy apparatus may have more than two play modes. The housing may have different shapes than those shown, for example, the housing illustrated in FIG. 4 is generally egg-shaped and the housing illustrated in FIG. 3 has an upper base that includes a surface having a compound curve in section view. However, here both versions of the upper base are designated by the same numeral "22" for clarity.

The lower base 14 includes a generally semi-spherical plastic shell 42 within which is mounted the relatively heavy flywheel 16 on a small diameter shaft 44. Also mounted to the shaft 44 is a small flywheel drive gear 46 for being engaged by the flexible rack 20 to enable a user to energize the flywheel. The shell 42 includes two openings 50, 52 formed in the shell approximately 130° apart. The openings 50, 52 are terminals for the rack passageway 18 allowing communication with the drive gear 46. Extending from the bottom of the shell 42 is a wide cover 54 for the shaft 44 about which the lower base 14, the upper base 22 and the doll 40 may rotate when placed on a flat surface or a wire. Covering the top of the shell 42 of the lower base 14 is a disk 60 having an outside screw thread 62 for engaging a mating inside screw thread 64 of the upper base 22 as will be explained below. In the alternative, the lower base may have a different shape, the drive gear may be larger or smaller, and the drive gear may be placed beneath the flywheel, if desired. Also, the cover 54 may be smaller or absent all together. The terminals for the passageway may also be spread wider than 130° or less than 130°, where the spread may be a function of the size and placement of the flywheel drive gear.

The upper base 22 of the housing 12 includes a plastic shell 70 which may have an essentially empty interior. Or, the upper base encloses the chamber 24 for one or more batteries, the first switch 26 mounted to the shell 70 so as to allow manual operation from outside the housing 12, the sound generator 32 which is operable by the first switch 26, and the second and third switches 28, 30 operable by centrifugal forces created by the flywheel when it is spinning. The upper base interior also includes the controller board 36 for controlling the sound generated and the light displayed. The upper base 22 may also include an appendage 71, FIG. 3, having one or more light sources, for example, three LEDs 72, 74, 76 that are illustrated in the drawings. Both the sound generator 32 and the light source 34 may be operated manually with the first switch 26 when the upper base 22 is being held by a user, and by the second and third switches 28, 30 when the upper base is being rotated. The second and third switches are placed in a generally perpendicular arrangement so that the centrifugal forces generated when the flywheel is activated closes both switches, but when the upper base is being held, merely shaking the upper base might close one, but not both, of the second and third switches at the same time.

A bottom cover 80 for the upper base 22 includes a outside lip 82 to retain the doll 40 against the upper base and the inside screw thread 64 to mate with the outside screw thread 62 of the disk 60 of the lower base. The bottom cover 80 may also include an access door for entry into the battery chamber 24. In the alternative, the shape of the upper base may be any that is convenient, such as the generally egg shape or oval shown in FIG. 4, when attached to the lower base. The controller board electronics may also be programmed to cause different sounds and/or lighting arrangements to emanate from the sound generator and the light source depending on whether the first switch is pushed by the user or whether the second and third switches are closed when the flywheel is rotated. As mentioned above, the switches, batteries, electronics, and sound and light capabilities may be removed for a basic, less costly version of the toy apparatus.

The doll covering 40 is formed of a fabric or other suitable material that allows the doll or other covering to be slipped over the upper base 22 and connected by the outside lip 82. The doll or other covering may look like a pet, a child, a model or may take any other form. The shape of the doll shown conforms to the upper base and may have a nose portion 83, FIG. 3, which is positioned over the first switch 26, if desired. The design features of the doll or other coverings may take any one of numerous forms so as to make the dolls or other coverings collectible items. For example, the doll shown has large floppy ears 84, 86, button eyes 88, 90, an extended tongue 92, short arms 94, 96, small feet 98, 100, colorful wild hair 102 and poke-a-dots, such as the poke-a-dot 104. In keeping with the doll motif a fabric tail appendage 106, FIG. 4, matching the features of the doll may be used as a cover the three LEDs 72, 74, 76. The cover 40 may be attached permanently, such as with the lip 82 or with adhesive, to the upper base, or the cover may be removably attached such as by being formed of elastic material, for example.

Figure 6B:
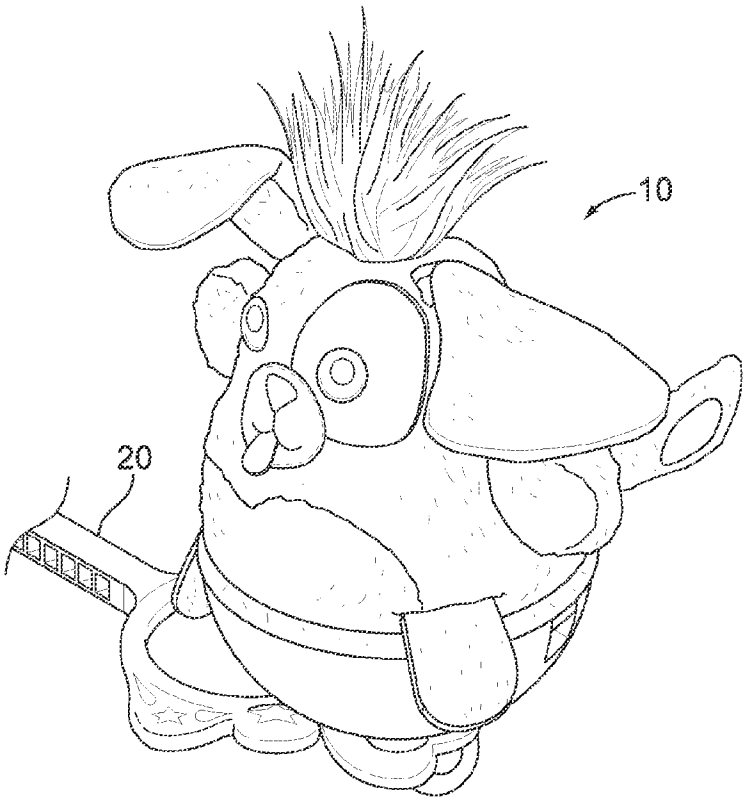
FIG. 6B is a front isometric view of the toy apparatus illustrating the doll-covered housing displayed on the rack.
Figure 6A:
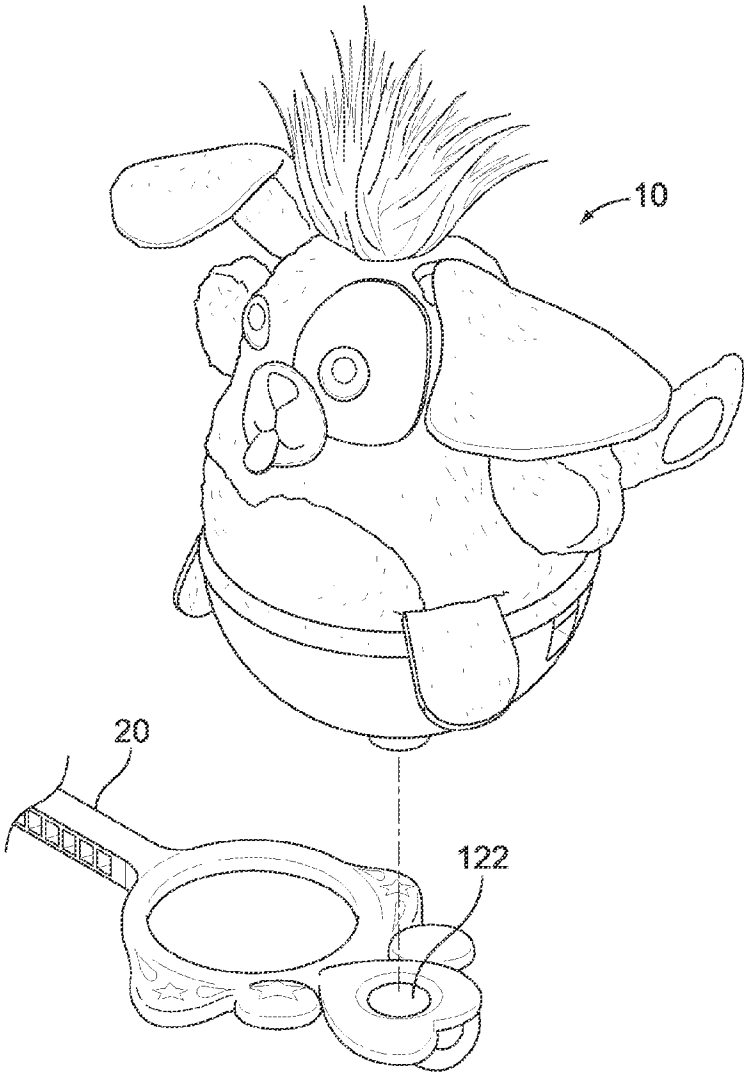
FIG. 6A is a front isometric view of the toy apparatus illustrating the doll covered housing about to be mounted to the rack.
Figure 7:
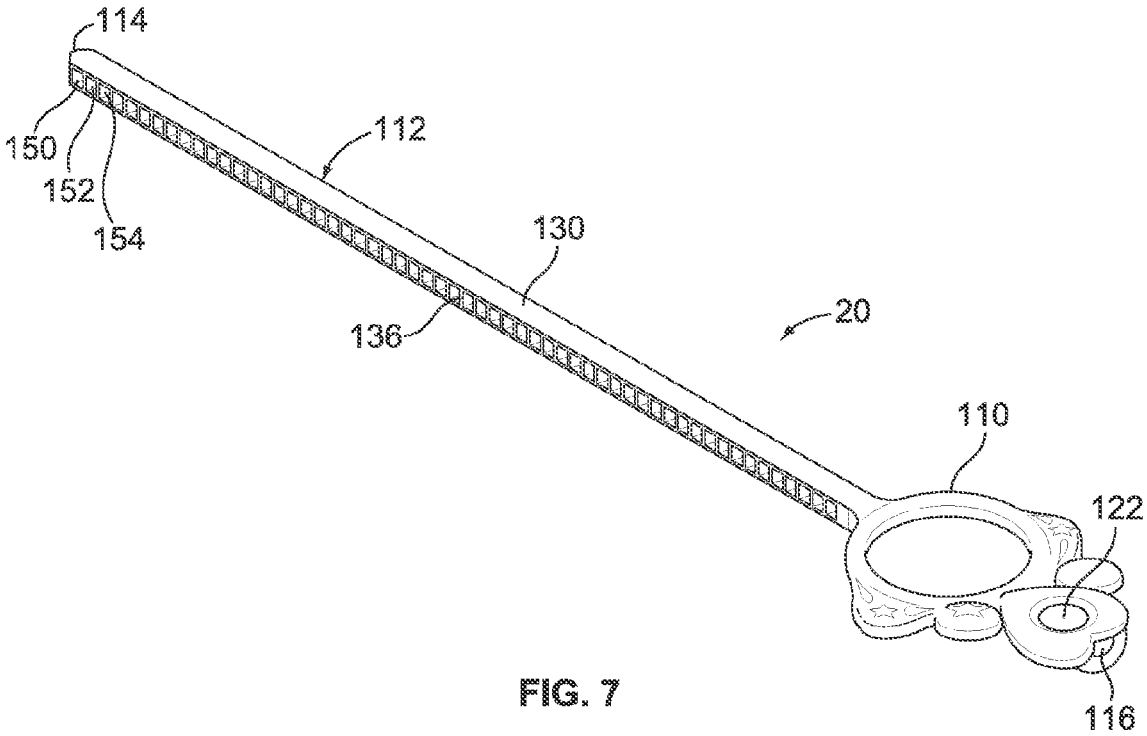
FIG. 7 is a front isometric view of the rack.
Figure 8:
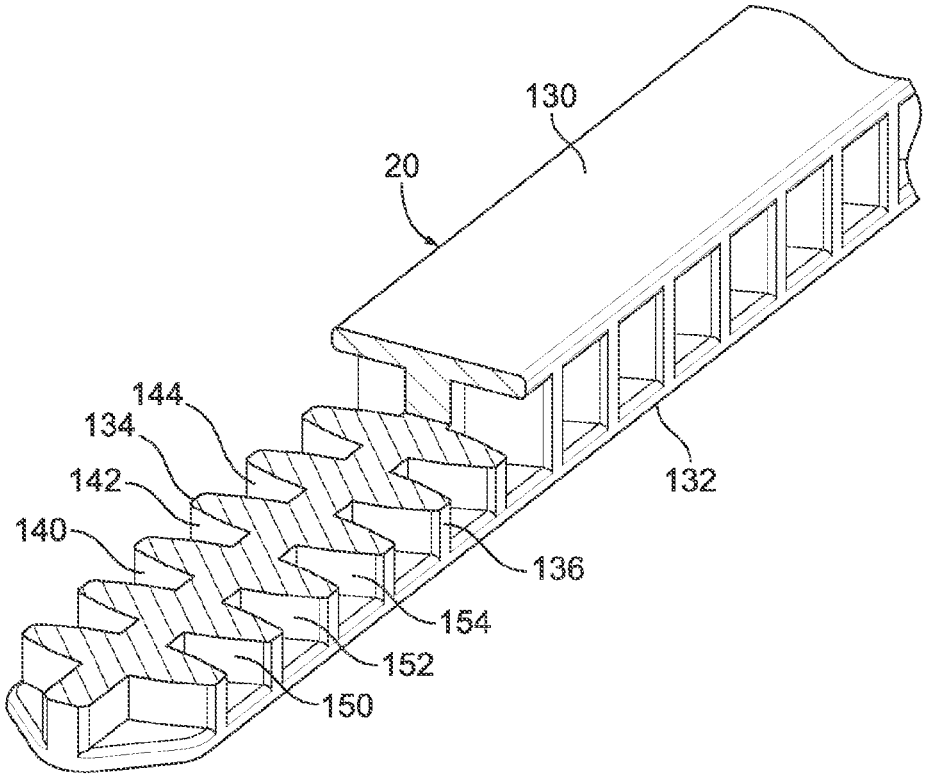
FIG. 8 is a partial sectional isometric view of the rack illustrating recessed gear teeth.
Figure 9:
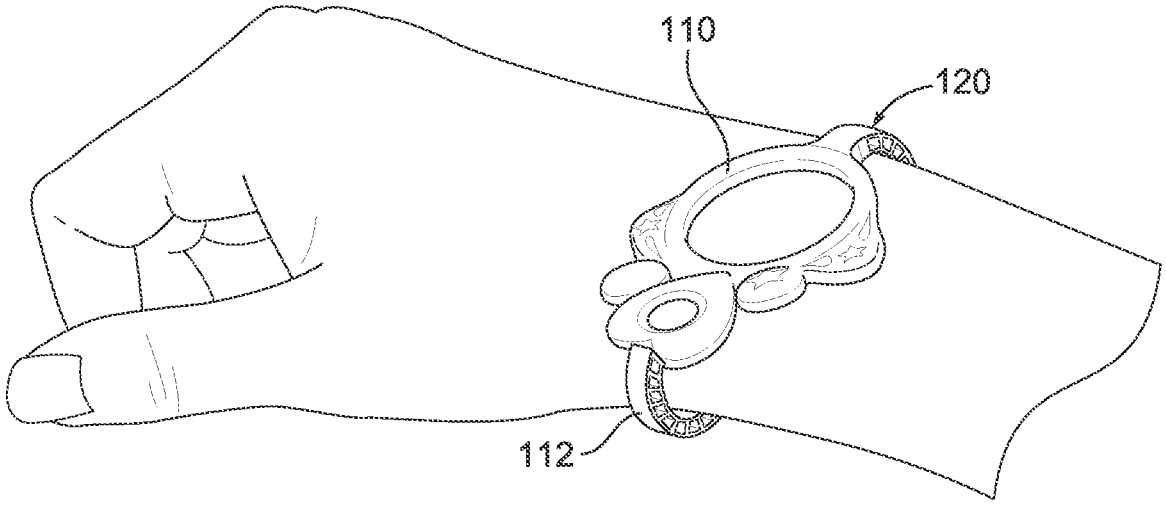
FIG. 9 is a partial isometric view of a hand with the rack looped and worn as a bracelet.

The flexible rack 20, FIGS. 6A, 6B, 7, 8 and 9, sometimes called a ripcord or pull cord, includes a ring-shaped handle 110 and an integral, elongated flexible bar 112. The extended or distal end portion 114 of the bar may include a connector prong. The handle includes an opening 116 so as to form a clasp when the prong is received by the opening. In this manner the rack may loop around and form a bracelet or a necklace, such as the bracelet shown in FIG. 9. The rack 20 may also include an indentation or depression 122, FIGS. 6A and 7, in the handle 110 for receiving and supporting the doll covered housing for storage and/or display as illustrated in FIG. 6B. A different clasp mechanism may be used in the alternative, and also in the alternative, a stand for the toy apparatus may be provided separate from or instead of the rack indentation to store and/or display the toy apparatus. The use of the flexible rack as make believe "jewelry" defines a third mode of play.

The bar has a rectangular cross section with two sets of opposing surfaces. The first set of opposing surfaces 130, 132 are smooth and uninterrupted. The second set of opposing surfaces 134, 136 each includes a series of evenly spaced recessed gear teeth for receiving the teeth of the drive gear 46. The surface 134, for example, includes recessed teeth 140, 142, 144 while the opposite surface 136, for example, includes recessed teeth 150, 152, 154. Recessed teeth in opposite sides of the flexible bar allows the rack to be used in either direction and upright or upside down to energize the flywheel, and when used as a bracelet, the use of recessed teeth prevents the wearer from being scratched and clothing from being snagged.

In operation, the toy apparatus 10 may be handled and played in two very different primary modes. In the first mode, the toy apparatus is operated as a top by inserting the rack into the rack passageway of the housing and quickly pulling the handle from the passageway. This movement causes the flywheel to rotate rapidly allowing the toy apparatus to spin and move on a flat surface or balance on a wire in gyroscopic fashion. With the sound and light embodiment, the rapid rotation also causes the second and third switches to close to energize the sound generator and the light source. In the second mode, an easy twisting motion separates the upper and lower bases and the upper base with the doll cover may be hand held. With the sound and light embodiment, depressing the first switch energizes the sound generator and the light source. As mentioned, the controller board may generate different sounds and light displays when the first switch is actuated from those generated when the second and third switches are actuated.

In the alternative, other modes of play may involve detaching the covered upper shell from the lower shell and collecting multiple upper shells with different covers. Or, upper shells with different covers may be exchanged and screwed onto a lower shell.

The present invention also includes a method for manufacturing the toy apparatus including the steps of forming the lower base enclosing the rotatable flywheel, the rack passageway and having a screw thread, forming the upper base enclosing the sound generator, the battery chamber, the three switches, the controller board and having the mating screw thread for engaging the screw thread of the lower base, and forming the doll cover to be placed over the upper base and connecting the doll to the upper base wherein the toy apparatus may be operated with the doll, the upper base and the lower base connected, or with only the upper base and the doll connected as described above in detail. The upper base may be formed with the appendage covered light source. The manufacturing process may also include forming the flexible rack with the handle and the flexible elongated bar, where the bar includes oppositely disposed surfaces with recessed gear teeth for operating the flywheel, and a clasp for retaining the bar in a closed loop. For the no sound, no light embodiment, manufacturing is simplified because the upper shell is essentially empty.

The toy apparatus disclosed in detail above has great play value, is fun to use and easy to operate because it is easily hand held and only requires the insertion and a quick pull of the flexible rack to cause rotation of the flywheel. Separation of the upper and lower bases for non-rotational play requires a simply twist motion similar to removing a lid from ajar.

From the foregoing, it can be seen that there has been provided features for an improved toy apparatus and a disclosure of the method of the toy's manufacture. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy apparatus comprising:

a housing comprising, a lower base portion, a detachable upper base portion, and a twistable separation attachment between the upper base portion and the lower base portion;

a flywheel enclosed within the lower base portion of the housing with the lower base portion including a passageway for a rack to rotate the flywheel;

a doll for covering the detachable upper base portion of the housing; and said detachable upper base including a chamber for a battery, a plurality of switches, a sound generator and a controller wherein the toy has two play modes, a first mode where the housing and doll spin rapidly to enable a switch to energize the sound generator, and a second mode where the housing and doll are handheld and another switch, manually operable, enables the sound generator to be energized.

2. The toy apparatus of claim 1, including:

an appendage connected to the upper base bearing a light source.

3. The toy apparatus of claim 1, including:

a flexible rack for energizing the flywheel.

4. The toy apparatus of claim 1, including:

a fastener for connecting the upper and lower bases.

5. The toy apparatus of claim 4, wherein:

the fastener includes an outside screw thread and a mating inside screw thread.

6. The toy apparatus of claim 1, including:

a third switch to operate in conjunction with the second switch and located in the upper base.

7. The toy apparatus of claim 6, wherein:

the first switch is manually operated when the toy apparatus is in the first mode.

8. The toy apparatus of claim 7, wherein:

the second and third switches are actuated by rotation of the flywheel.

9. The toy apparatus of claim 8, including:

an appendage connected to the upper base for bearing a light source.

10. The toy apparatus of claim 9, including:

a flexible rack for energizing the flywheel.

11. The toy apparatus of claim 10, wherein:

the flexible rack includes a handle and an elongated flexible bar extending from the handle, the bar having a rectangular cross section with opposing surfaces wherein each of the opposing surfaces includes a series of evenly spaced recessed teeth for receiving teeth of a flywheel drive gear.

12. The toy apparatus of claim 11, including:

a fastener for connecting the upper and lower bases.

13. The toy apparatus of claim 12, wherein:

the fastener includes an outside screw thread and a mating inside screw thread.

14. A toy apparatus comprising:

a lower base enclosing a flywheel and a passageway for a rack;

an upper base detachably connectible to the lower base, the upper base enclosing a chamber for a battery, a first switch, a second switch, a sound generator and a controller for the sound generator;

a twistable separation attachment connecting the upper and lower bases; and a doll for covering the upper base wherein the first switch is manually operated and the second switch is actuated when the flywheel is spinning wherein the toy has two play modes, a first mode where the housing and doll spin rapidly to enable a switch to energize the sound generator, and a second mode where the housing and doll are handheld and another switch, manually operable, enables the sound generator to be energized.

15. The toy apparatus of claim 14, including:

an appendage connected to the upper base bearing a light source and operatively connected to the first and second switches and the controller.

16. The toy apparatus of claim 14, including:

a fastener for connecting the upper and lower bases.

17. The toy apparatus of claim 16, wherein:

the fastener includes an outside screw thread and a mating inside screw thread.

18. The toy apparatus of claim 14, including:

a flexible rack for energizing the flywheel.

* * * * *